US007624665B1

(12) United States Patent
Lee

(10) Patent No.: US 7,624,665 B1
(45) Date of Patent: Dec. 1, 2009

(54) CASE ACTIVATED DRUM POWDER MEASURE

(76) Inventor: Richard J. Lee, 3146 Kettle Moraine Rd., Hartford, WI (US) 53207

( * ) Notice: Subject to any disclaimer, the term of this patent is extended or adjusted under 35 U.S.C. 154(b) by 0 days.

(21) Appl. No.: 12/341,172

(22) Filed: Dec. 22, 2008

(51) Int. Cl.
*F42B 33/02* (2006.01)

(52) U.S. Cl. ..... 86/31; 86/29; 86/20.1

(58) Field of Classification Search ..... 86/23, 86/25, 29, 31, 20.1; 222/548, 363–370
See application file for complete search history.

(56) References Cited

U.S. PATENT DOCUMENTS

| | | | | | |
|---|---|---|---|---|---|
| 481,127 | A | * | 8/1892 | Wagner | 86/31 |
| 1,991,742 | A | * | 2/1935 | Green | 222/410 |
| 1,996,044 | A | * | 3/1935 | Green | 222/231 |
| 2,050,756 | A | * | 8/1936 | Kubo | 222/324 |
| 2,194,143 | A | * | 3/1940 | Ganter | 222/359 |
| 2,532,698 | A | * | 12/1950 | Corkins | 222/139 |
| 2,538,413 | A | * | 1/1951 | Chard | 222/650 |
| 2,550,827 | A | * | 5/1951 | Lachmiller | 222/308 |
| 2,778,528 | A | * | 1/1957 | Corcoran | 222/46 |
| 3,029,574 | A | * | 4/1962 | Anderson | 222/363 |
| 3,090,524 | A | * | 5/1963 | Corcoran | 222/46 |
| 3,140,018 | A | * | 7/1964 | Miller | 222/283 |
| 3,311,272 | A | * | 3/1967 | Westbrook | 222/355 |
| 3,336,829 | A | * | 8/1967 | Lee | 86/23 |
| 3,386,329 | A | * | 6/1968 | Rohrbacher | 86/31 |
| 3,670,928 | A | * | 6/1972 | Hanson | 222/288 |
| 4,151,933 | A | * | 5/1979 | Myers | 222/288 |
| 4,418,606 | A | * | 12/1983 | Lee | 86/31 |
| 4,522,102 | A | * | 6/1985 | Pickens | 86/27 |
| 5,024,135 | A | * | 6/1991 | Bender | 86/31 |
| 5,179,243 | A | * | 1/1993 | Schroeder | 86/25 |
| 5,202,529 | A | * | 4/1993 | Shields | 86/23 |
| 5,292,037 | A | * | 3/1994 | Held | 222/339 |
| 5,763,810 | A | * | 6/1998 | Lee | 86/45 |

OTHER PUBLICATIONS

Hornady Website printout of a Case Activated Powder Drop Improved @ www.hornady.com, Nov. 25, 2008.

* cited by examiner

*Primary Examiner*—Michael Carone
*Assistant Examiner*—Jonathan C Weber
(74) *Attorney, Agent, or Firm*—Donald J. Ersler

(57) ABSTRACT

A case activated drum powder measure includes a measure body, a powder drum, a drive assembly and an actuation assembly. The measure body includes a drum receiver, an actuation tube and a hopper. The powder drum includes a powder cavity and is retained in the drum receiver. One end of an expanding die is secured to the actuation tube and the other end is secured to a loading press. A connecting rod transmits linear motion from the actuation assembly to rotate the powder drum through the drive assembly. Gun powder fills the powder cavity through the hopper. A case is retained in a shell holder retained in a ram of the reloading press. A lever arm is pulled, which causes the ram to push the case into the expanding die. Upward movement of the case causes the gun powder in the powder cavity to fall into the case.

20 Claims, 4 Drawing Sheets

CASE ACTIVATED DRUM POWDER MEASURE

BACKGROUND OF THE INVENTION

1. Field of the Invention

The present invention relates generally to devices used in reloading ammunition and more particularly to a case activated drum powder measure, which provides automatic reloading of a cartridge case with gunpowder by the upward movement of the cartridge case in a reloading press.

2. Discussion of the Prior Art

Case activated powder charging was originally introduced by the inventor in U.S. Pat. No. 4,418,606 to Richard J. Lee. The Lee invention is well understood and has been used for over a quarter century. Its usefulness has been limited to sliding charge bars due to the short stroke of 0.4 inch provided by standard "powder through expanding dies." Rotating drum powder measures, such as those illustrated in U.S. Pat. No. 2,550,827 to Lachmiller and U.S. Pat. No. 4,151,933 to Myers require a longer stroke to rotate the powder drum at least 120 to 180 degrees. Rotating drum powder measures are desirable, because they are infinitely adjustable within the maximum capacity, and are considered more accurate by the consumer. It is difficult and expensive to convert vertical travel to 120 degrees or more by the use of rotary motion with levers, cranks and connecting rods.

The rotating drum powder measures are normally not case activated due to the long stroke required. Recently, adaptors such as the "Case Activated Powder Drop Improved" manufactured by Hornday have been offered as retrofits for certain drum type measures. A webpage illustration of the Hornady device is recited in the information disclosure statement. The Hornady device uses multiple levers, which are costly, cumbersome, and may damage the case mouth due to the force required to operate the powder measure and the return spring. It appears that the prior art does not disclose an economical case activated drum powder measure, especially for standard dies that have a 0.4 inch stroke.

Accordingly, there is a clearly felt need in the art for a case activated drum powder measure, which provides automatic reloading of a cartridge case with gunpowder by the upward movement of the cartridge case in a reloading press, without a complicated linkage mechanism.

SUMMARY OF THE INVENTION

The present invention provides a case activated drum powder measure, which is activated by the upward movement of a cartridge case. The case activated drum powder measure includes a measure body, a powder drum, a drive assembly and an actuation assembly. The measure body includes a drum receiver, an actuation tube and a hopper receiver. The hopper receiver extends from a top of the drum receiver and the actuation tube extends from a bottom of the drum receiver. The hopper receiver communicates with the drum receiver through a feed opening and the actuation tube communicates with the drum receiver through a drop opening. The powder drum includes a powder tube and a powder drum shank. A powder cavity is formed in the powder tube. A volume adjustment screw is threaded into the powder cavity to vary the volume capacity of the powder cavity. The drive assembly includes a connecting rod, a gear case, a sun gear and a planet gear. The actuation assembly includes an actuator, a drop tube, an expanding die and a case mouth expander.

A planet gear pin is inserted through one end of the connecting rod, the planet gear and a yoke. A shoulder of the sun gear is inserted through the yoke and the gear case and axially secured to the gear case with a retaining ring. An alternative drive assembly includes the connecting rod, the sun gear and a drive gear. The drive gear is pivotally retained on the gear case. The powder drum is inserted into the drum receiver and radially secured with a chain drum and a thumb screw. A compression spring is pushed over the connecting rod. The actuator is inserted into the actuation tube and the other end of the connecting rod is secured to the actuator with a actuator arm pin. An adapter is inserted into the actuation tube behind the actuator. One end of the drop tube is inserted into the adapter and actuator. The case mouth expander is pushed over the other end of the drop tube. The expanding die is threaded on to the adapter. A hopper is pushed into the hopper receiver.

The expanding die is threaded into a top of a press frame of a reloading press and secured thereto with a jam nut. Gun powder is poured into the hopper. Some of the gun powder in the hopper fills the powder cavity. A shell holder is retained in a ram of the reloading press and a case is retained in the shell holder. A lever arm of the reloading press is pulled downward, which causes the ram to push the case into the expanding die. The case pushes the mouth expander upward, which causes the connecting rod to rotate the powder cavity in the powder drum from an alignment with the feed opening to an alignment with the drop opening. The angle between the feed opening and the drop opening is preferably minimized to 120 degrees. Either drive system reduces the required linear movement of the case to rotate the powder drum by one half. The gun powder in the powder cavity falls into the case. The lever arm is retracted, which removes the case from the case mouth expander and the compression spring causes the powder cavity in the power drum to rotate back, such that the powder cavity is in alignment with the feed opening.

Accordingly, it is an object of the present invention to provide a case activated drum powder measure, which provides automatic reloading of a cartridge case with gunpowder by the upward movement of the cartridge case in a reloading press, without a complicated linkage mechanism.

Finally, it is another object of the present invention to provide a case activated drum powder measure, which is economical to manufacture and use.

These and additional objects, advantages, features and benefits of the present invention will become apparent from the following specification.

DETAILED DESCRIPTION OF THE PREFERRED EMBODIMENTS

Figure 1:
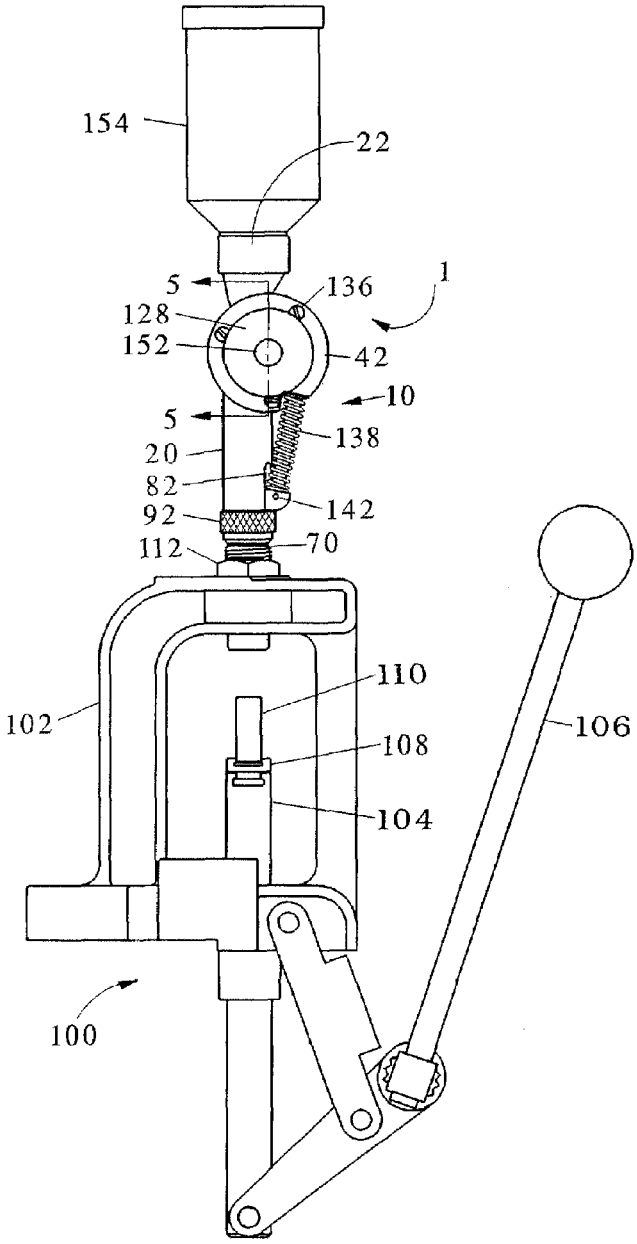
FIG. 1 is a front view of a case activated drum powder measure retained in a reloading press in accordance with the present invention.

With reference now to the drawings, and particularly to FIG. 1, there is shown a front view of a case activated drum powder measure 1 retained in a reloading press 100. The reloading press 100 includes a press frame 102, a ram 104 and a lever arm 106. Reloading presses are well known in the art and need not be explained in further detail. A shell holder 108 is secured to an end of the ram 104. A case 110 is retained in the shell holder 108.

Figure 2:
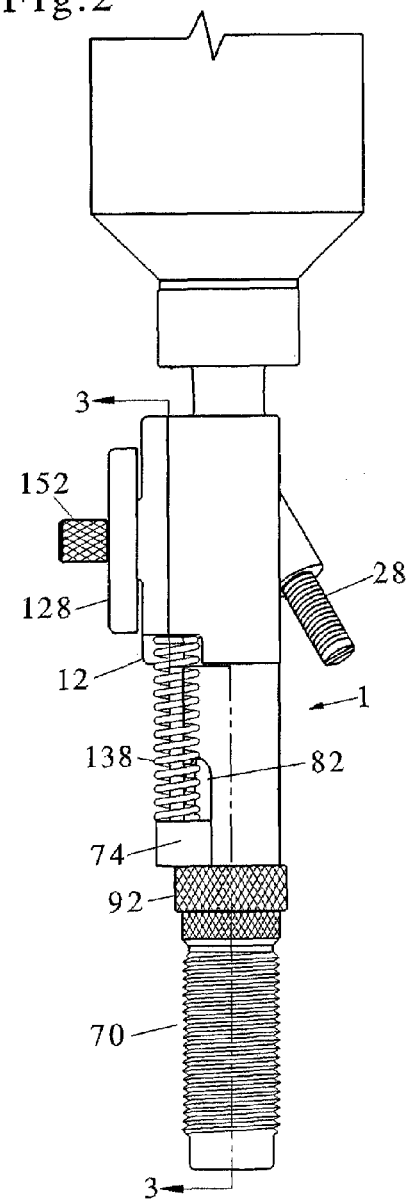
FIG. 2 is a side view of a case activated drum powder measure in accordance with the present invention.
Figure 3:
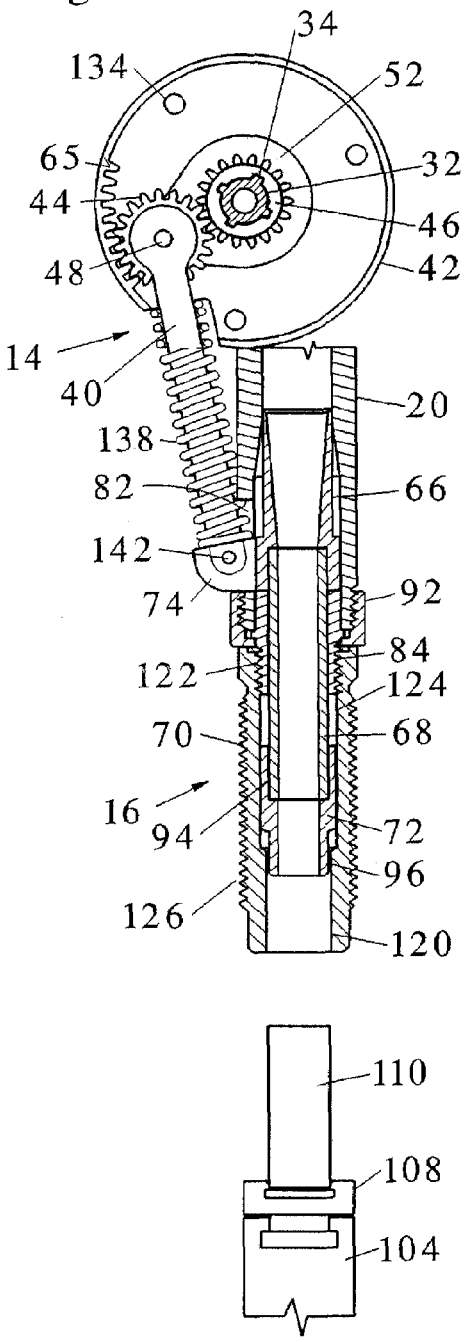
FIG. 3 is a front cross sectional view of a case activated drum powder measure cut through FIG. 2 in accordance with the present invention.
Figure 4:
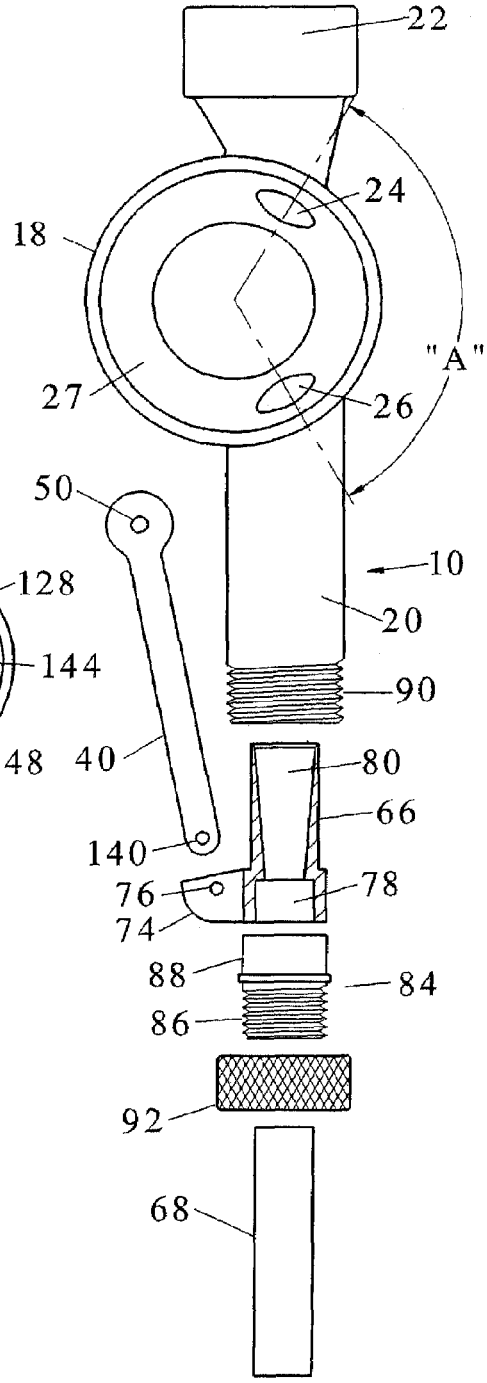
FIG. 4 is a partially exploded front view of a measure body, a connecting rod, an actuator, an adapter, a retaining nut and a drop tube of a case activated drum powder measure in accordance with the present invention.

With reference to FIGS. 2-4, the case activated drum powder measure 1 includes a measure body 10, a powder drum 12, a drive assembly 14 and an actuation assembly 16. The measure body 10 includes a drum receiver 18, an actuation tube 20 and a hopper receiver 22. The hopper receiver 22 extends from a top of the drum receiver 18 and the actuation tube 20 extends from a bottom of the drum receiver 18. The hopper receiver 22 communicates with the drum receiver 18 through a feed opening 24 and the actuation tube 20 communicates with the drum receiver 18 through a drop opening 26. The feed opening 24 and the drop opening 26 are separated by an angle "A." Angle has a preferably value of 120 degrees, but other angle values may also be used.

Figure 5:
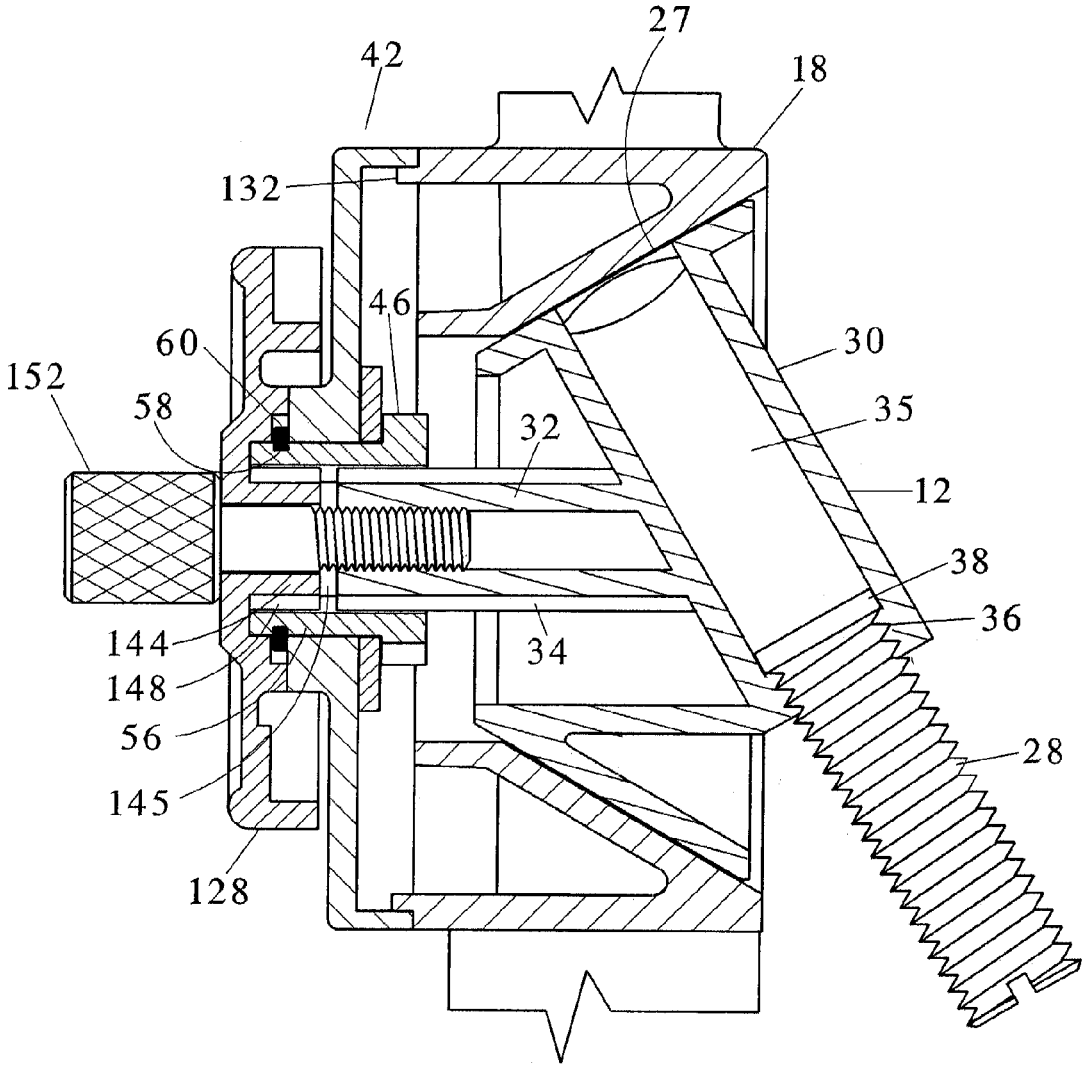
FIG. 5 is a side cross sectional view of a portion cut through FIG. 1 of a case activated drum powder measure in accordance with the present invention.

With reference to FIG. 5, a conical cavity 27 is preferably formed in one side of the drum receiver 18 to receive a conical body of the powder drum 12. However, a powder drum with a cylindrical body may also be used. The powder drum 12 with the conical body is desirable because it affords zero clearance with the conical cavity 27; the conical body is adjustable for wear; and provides better clearance for a volume adjustment screw 28.

Figure 6:
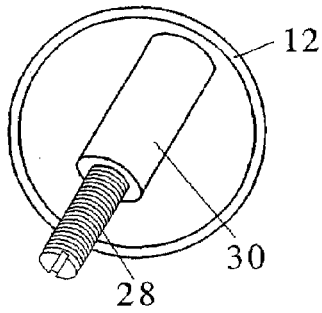
FIG. 6 is an end view of a powder drum of a case activated drum powder measure in accordance with the present invention.

With reference to FIG. 6, the powder drum 12 includes a powder tube 30 and a powder drum shaft 32. A plurality of spline projections 34 are formed on an outer perimeter of the powder drum shaft 32. A powder cavity 35 is formed in the powder tube 30. A threaded portion 36 is formed in an end of the powder cavity 35 to threadably receive the volume adjustment screw 28. The volume adjustment screw 28 is threaded into the threaded portion 36 of the powder cavity 35 to vary the volume capacity of the powder cavity 35. A cylinder bearing surface 38 is formed on an end of the volume adjustment screw 28 to contact the powder cavity 35.

Figure 7:
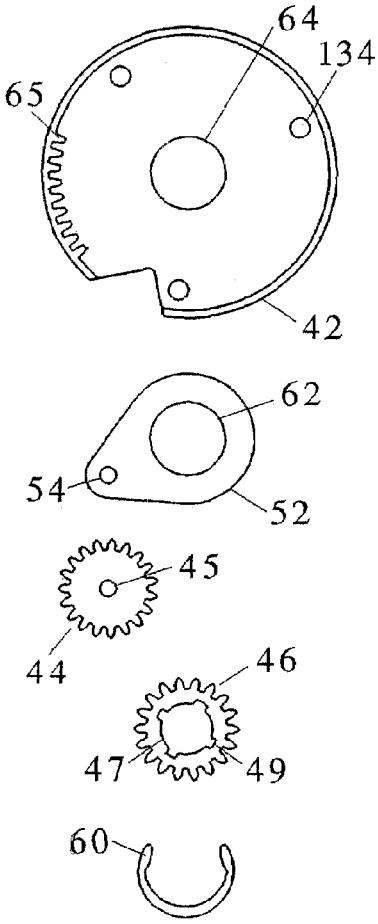
FIG. 7 is a partially exploded end view of a drive assembly of a case activated drum powder measure in accordance with the present invention.
Figure 8:
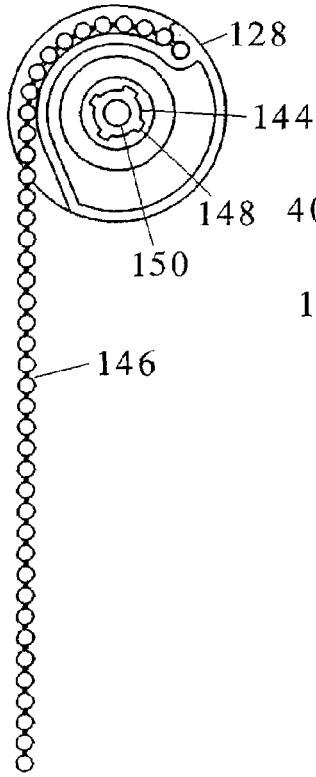
FIG. 8 is an end view of a chain drum of a case activated drum powder measure in accordance with the present invention.

With reference to FIGS. 7-8, the drive assembly 14 includes a connecting rod 40, a gear case 42, a planet gear 44 and a sun gear 46. A planet gear pin 48 is inserted through a pivot hole 50 formed through one end of the connecting rod 40; a shaft hole 45 formed through the planet gear 44; and a first pivot hole 54 in a yoke 52. The planet gear pin 48 is preferably press fitted into the pivot hole 50 of the connecting rod 40. The planet gear 44 and the yoke 52 cannot slide off the planet gear pin 48, because the planet gear 44 and yoke 52 are captured in a cavity formed between the gear case 42 and the drum receiver 18. The sun gear 46 includes a shoulder 56. A ring groove 58 is formed in a perimeter of the shoulder 56 to receive a retaining ring 60. The shoulder 56 of the sun gear 46 is inserted through a shoulder hole 62 in the yoke 52 and a pivot hole 64 in the gear case 42. The sun gear 46, the yoke 52 and the gear case 42 are radially secured to each other by snapping the retaining ring 60 in the ring groove 58. A rack 65 is formed on an inside perimeter of the gear case 42 to mesh with the planet gear 44. The rack 65 is twice the distance of the linear travel of the connecting rod 40. The planetary gear drive system enables the connecting rod 40 to produce a rotational angle that is twice that of a normal geared drive. The planetary gear drive system also reduces the required linear movement of the case 110 to rotate the powder drum 12 by one half.

Figure 3A:
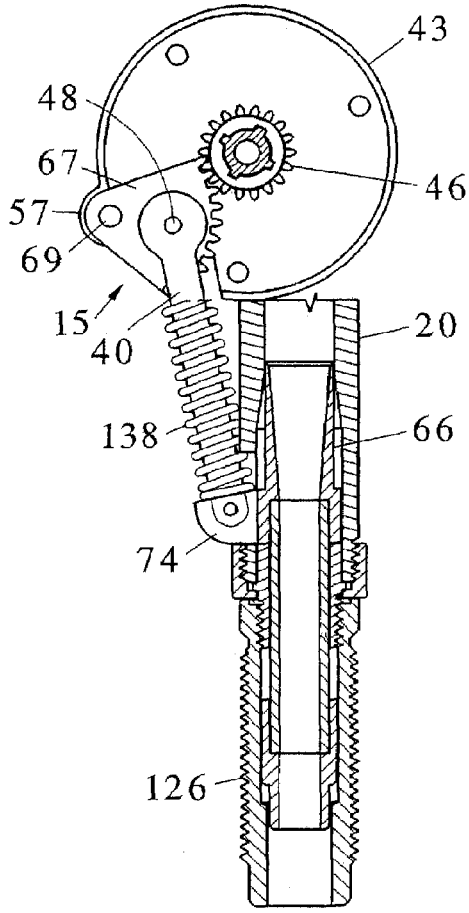
FIG. 3*a* is a front cross sectional view of a case activated drum powder measure cut through FIG. 2 with an alternative drive assembly in accordance with the present invention.

With reference to FIG. 3*a*, an alternative drive assembly 15 includes the connecting rod 40, the sun gear 46 and a drive gear 67. The drive gear 67 is pivotally retained on a pivot boss 57 of the gear case 43 with a pivot pin 69. The alternative drive system 15 enables the connecting rod 40 to produce a rotational angle that is twice that of a normal geared drive. The alternative drive system also reduces the required linear movement of the case 110 to rotate the powder drum 12 by one half.

The actuation assembly 16 includes an actuator 66, a drop tube 68, an expanding die 70 and a case mouth expander 72. The actuator 66 includes an actuator arm 74 extending from a bottom perimeter of the actuator 66. A pivot hole 76 is formed through the actuator arm 74. A tube counterbore 78 is formed in a bottom of the actuator 66, which is sized to receive the drop tube 68. A tapered bore 80 is formed in a top of the actuator and communicates with tube counterbore 78. The actuator 66 is inserted into the actuation tube 20. An arm clearance 82 is formed in a bottom of the actuation tube 20 to provide clearance for the linear movement of the actuator arm 74.

An adapter 84 includes a threaded end 86 and a tube end 88. The tube end 88 is inserted into the actuator tube 20. A retention thread 90 is formed on a bottom of the actuator tube 20 to threadably receive a retaining nut 92. The retaining nut 92 retains the adapter 84 in the actuator tube 20. The case mouth expander 72 includes a tube counterbore 94 and a necked down perimeter 96. The necked down perimeter 96 is sized to expand an inner perimeter of the case 110 to create a 0.001-0.003 inches press fit with a bullet. The expanding die 70 includes a case bore 120, a female thread 122, a case expander bore 124 and a threaded perimeter 126. One end of the drop tube 68 is inserted into the adapter 66 and the case mouth expander 72 pushed over the other end of the drop tube 68. The case expander bore 124 is sized to receive the case mouth expander 72. The female thread 122 is sized to threadably receive the threaded end 86 of the adapter 84. The case bore 120 is sized to receive an outer perimeter of the case 110. The threaded perimeter 126 is threaded into the press frame 102 and secured with a jam nut 112.

The powder drum 12 is inserted into the drum receiver 18 and radially secured therein with a chain drum 128 and a thumb screw 152. A location ring 132 preferably extends from the other side of the drum receiver 18. The location ring 132 is sized to receive an inner perimeter of the gear case 42. The gear case 42 includes a plurality of fastener holes 134. A plurality of case fasteners 136 are inserted through the plurality of fastener holes 134 and threaded into the other side of the drum receiver 18. The sun gear 46 includes a shaft hole 47 and a plurality of spline slots 49, which are sized to receive the plurality of spline projections 34 on the powder drum shaft 32.

A compression spring 138 is pushed over the connecting rod 40. An actuation arm hole 140 is formed through the other end of the connecting rod 40. An actuation arm pin 142 is inserted through the actuation arm hole 140 and the pivot hole 76 in the actuation arm 74. The actuation arm pin 142 is preferably press fitted with the actuation arm hole 140 in the connecting rod 40. The chain drum 128 includes a shaft boss 144 and a pull chain 146. The pull chain 146 is optional and may be attached to the ram 104 to eliminate the need for the compression spring 138. A plurality of spline projections 148 are formed around the shaft boss 144. The plurality of spline projections 148 are sized to be received by the plurality of spline slots 49 in the sun gear 46. To insure proper assembly between the shaft boss 144, the powder drum shaft 32 and the sun gear 46, at least one of the plurality of spline slots 49 is oversized.

The shaft boss 144 of the chain drum 128 is pushed part way into one end of the shaft hole 47 of the sun gear 46. The powder drum shaft 32 is pushed into the opposite end of the shaft hole 47 of the sun gear 46. A gap 145 between an end of the powder drum shank 32 and an end of the shaft boss 144 allows a user to adjust the tightness of the thumb screw 152 for zero clearance between the conical cavity 27 and the powder drum 12. The chain drum 128 includes a screw hole 150, which is sized to receive a thumb screw 152. The thumb screw 152 is threaded into a threaded tap 33 in the powder drum shaft 32 to retain the powder drum 12 in the conical cavity 27.

A hopper 154 is pushed into the hopper receiver 22. Gun powder (not shown) is poured into the hopper 154. A portion of the gun powder fills the powder cavity 35. The lever arm 106 of the reloading press 100 is pulled downward, which causes the ram 104 to push the case 110 into the expanding die 70. The case 110 pushes the case mouth expander 72 upward, which causes the connecting rod 40 to rotate the powder cavity 35 in the powder drum 12 from an alignment with the feed opening 24 to an alignment with the drop opening 26. The gun powder in the powder cavity 35 falls into the case 110. The lever arm 106 is retracted, which removes the case 110 from the case mouth expander 72 and the compression spring 138 (or in the alternative the drum chain 146) causes the powder cavity 35 in the power drum 12 to rotate back, such that the powder cavity 35 is back in alignment with the feed opening 24.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A case activated drum powder measure comprising:

a measure body including a drum receiver, an actuation tube and a hopper, said hopper communicating with said drum receiver through a feed opening, said drum receiver communicating with said actuation tube through a drop opening;

a powder drum including a powder cavity, said powder drum being rotatably retained in said drum receiver, said powder cavity receiving powder from said hopper; and a connecting rod transmits the linear motion of a case to rotate said powder drum through at least two gears, said powder cavity drops powder contained therein through said drop opening and said actuation tube into the case.

2. The case activated drum powder measure of claim 1, further comprising:

a reloading press including a lever arm, said case activated drum powder measure being retained in said reloading press, said lever arm being pulled to provide the case with linear motion.

3. The case activated drum powder measure of claim 2, further comprising:

a chain drum including a chain, said chain drum being retained on said powder drum, said chain being secured to a ram of said reloading press, said chain causing said powder cavity to be aligned with said feed opening, when said ram is retracted.

4. The case activated drum powder measure of claim 1, further comprising:

an actuation assembly including an expanding die, a case mouth expander and an actuator, said expanding die being retained on a bottom of said actuation tube, said case mouth expander and said actuator being retained in said expanding die, said case mouth expander receiving the case, linear movement of said case causing linear movement of said actuator.

5. The case activated drum powder measure of claim 4, further comprising:

one of said at least two gears being a planet gear, said planet gear being pivotally retained on one end of said connecting rod, said planet gear causing the rotation of said powder drum, the other end of said connecting rod being pivotally connected to said actuator.

6. The case activated drum powder measure of claim 5, further comprising:

a gear case including an internal gear rack, a sun gear extending from said powder drum, said planet gear meshing with said internal gear rack and said sun gear.

7. The case activated drum powder measure of claim 1, further comprising:

a sun gear extending from said powder drum, a drive gear being pivotally retained on said powder drum, said drive gear meshing with said sun gear.

8. A case activated drum powder measure comprising:

a measure body including a drum receiver, an actuation tube and a hopper, said hopper communicating with said drum receiver through a feed opening, said drum receiver communicating with said actuation tube through a drop opening;

a powder drum including a powder cavity, said powder drum being rotatably retained in said drum receiver, said powder cavity receiving powder from said hopper; and a connecting rod transmits the linear motion of a case to rotate said powder drum through a first gear driving a second gear retained on said powder drum to rotate said powder drum, said powder cavity drops powder contained therein through said drop opening and said actuation tube into the case.

9. The case activated drum powder measure of claim 8, further comprising:

a reloading press including a lever arm, said case activated drum powder measure being retained in said reloading press, said lever arm being pulled to provide the case with linear motion.

10. The case activated drum powder measure of claim 9, further comprising:

a chain drum including a chain, said chain drum being retained on said powder drum, said chain being secured to a ram of said reloading press, said chain causing said powder cavity to be aligned with said feed opening, when said ram is retracted.

11. The case activated drum powder measure of claim 8, further comprising:

an actuation assembly including an expanding die, a case mouth expander and an actuator, said expanding die being retained on a bottom of said actuation tube, said case mouth expander and said actuator being retained in said expanding die, said case mouth expander receiving the case, linear movement of said case causing linear movement of said actuator.

12. The case activated drum powder measure of claim 11, further comprising:

a planetary gear system including a planet gear, said planet gear being pivotally retained on one end of a connecting rod, said planet gear causing the rotation of said powder drum, the other end of said connecting rod being pivotally connected to said actuator.

13. The case activated drum powder measure of claim 12, further comprising:

a gear case including an internal gear rack, a sun gear extending from said powder drum, said planet gear meshing with said internal gear rack and said sun gear.

14. The case activated drum powder measure of claim 8, further comprising:

a sun gear extending from said powder drum, a drive gear being pivotally retained on said powder drum, said drive gear meshing with said sun gear.

15. A case activated drum powder measure comprising:

a measure body including a drum receiver, an actuation tube and a hopper, said hopper communicating with said drum receiver through a feed opening, said drum receiver communicating with said actuation tube through a drop opening;

a powder drum including a powder cavity, said powder drum being rotatably retained in said drum receiver, said powder cavity receiving powder from said hopper; and a connecting rod transmits the linear motion of a case on one end, a first gear being pivotally retained on the other end of said connecting rod, a second gear being retained on said powder drum, said first gear driving said second gear to rotate said powder drum, said powder cavity drops powder contained therein through said drop opening and said actuation tube into the case.

16. The case activated drum powder measure of claim 15, further comprising:

a reloading press including a lever arm, said case activated drum powder measure being retained in said reloading press, said lever arm being pulled to provide the case with linear motion.

17. The case activated drum powder measure of claim 16, further comprising:

a chain drum including a chain, said chain drum being retained on said powder drum, said chain being secured to a ram of said reloading press, said chain causing said powder cavity to be aligned with said feed opening, when said ram is retracted.

18. The case activated drum powder measure of claim 15, further comprising:

an actuation assembly including an expanding die, a case mouth expander and an actuator, said expanding die being retained on a bottom of said actuation tube, said case mouth expander and said actuator being retained in said expanding die, said case mouth expander receiving the case, linear movement of said case causing linear movement of said actuator.

19. The case activated drum powder measure of claim 18, further comprising:

the other end of said connecting rod being pivotally connected to said actuator.

20. The case activated drum powder measure of claim 15, further comprising:

a compression spring being slipped over said connecting rod, said compression spring biasing said powder cavity to be aligned with said feed opening.

* * * * *